United States Patent [19]

Brolin

[11] 4,139,044

[45] Feb. 13, 1979

[54] BALL CORD LOCK

[75] Inventor: Hans R. Brolin, Mullsjö, Sweden

[73] Assignee: AB Perma System, Mullsjö, Sweden

[21] Appl. No.: 816,011

[22] Filed: Jul. 15, 1977

[51] Int. Cl.[2] ..... A47G 5/02

[52] U.S. Cl. ..... 160/321; 160/291

[58] Field of Search ..... 160/291, 293, 298, 299, 160/300, 303, 304 C, 307, 308, 309, 319, 320, 321; 188/65.1, 65.2; 254/191, 192

[56] References Cited

U.S. PATENT DOCUMENTS

| | | | |
|---|---|---|---|
| 1,613,071 | 1/1927 | Williams | 188/65.1 |
| 2,350,085 | 5/1944 | Yashan | 160/293 R |
| 2,577,046 | 12/1951 | Svirsky | 160/321 |
| 2,894,578 | 7/1959 | Caesar et al. | 160/308 |
| 2,907,549 | 10/1959 | Walker | 254/192 |
| 3,424,224 | 1/1969 | Lowe | 160/308 |

*Primary Examiner*—Peter M. Caun

*Attorney, Agent, or Firm*—Witherspoon, Lane & Hargest

[57] ABSTRACT

Ball cord lock intended to be used for roller blinds and comprising a cord pulley having an axially extending stub axle for receiving and retaining one end of a roller blind rod, an endless ball cord arranged around the cord pulley and in engagement therewith and which during operation windsup and unwinds respectively a blind attached to the roller blind rod, a lock housing formed by two complementary housing halves which housing constitutes journal for and encloses the cord pulley, a bracket which is connected to the lock housing and which is intended to be mounted at a window, and a U-shaped cord locking portion formed in the lock housing for catching and retaining one of the loops of the ball cord whereby the rotation of the cord pulley in one direction and accordingly unwinding of the blind in wound-up condition is prevented. The U-shaped cord locking portion is arranged immediately adjacent the periphery of the cord pulley under one of the freely suspending loops of the ball cord. The open part of the U-shaped cord locking portion is directed towards the other of the loops of the ball cord. The depth of the U-shaped cord locking portion in vertical direction is increasing from the open part towards the closed part of the portion. The edge surfaces of the U-shaped cord locking portion located closest to the cord pulley constitutes a slip plane for the balls of the ball cord.

1 Claim, 5 Drawing Figures

BALL CORD LOCK

The present invention relates to a ball cord lock for a roller blind. The ball cord lock is intended to be connected to and supporting one end of a new type of roller blind rod lacking the conventional centrifugal clutch and the wind-up spring. The other end of the roller blind rod is in a conventional way rotatably journalled in a mounting member. The wind-up and unwinding of the roller blind takes place by the aid of a ball cord arranged in the ball cord lock and which is suspending from the ball cord lock and is manually operated.

A similar device is described in U.S. Pat. No. 2,577,046. In said specification there is shown a ball cord lock including a lock housing mountable to the wall and in which a cord pulley is turnably journalled. The cord pulley supports a ball cord the one loop of which is lockable to a U-shaped portion recessed in the lock housing. In order to obtain a self-locking function of the ball cord the lock housing is provided with an inwardly ben portion deflecting the ball cord from the vertical line in direction towards the recessed portion for the locking of the ball cord. In order to release the ball cord from the locked position the ball cord is moved out of the U-shaped portion to a broader portion allowing clearance for the balls of the ball cord. However, said movement must be carried out in connection with the wind-up as well as the unwinding of the roller blind which is a drawback. Further, the device in accordance with the U.S. patent specification is complicated and the shape thereof is neither useful for the new type of roller blind rods.

The present invention has reference to a ball cord lock having a simple structure and which fulfils the new requirements in connection with the interior decorating.

The special features of the invention are clear from the attached claim.

Figure 1:
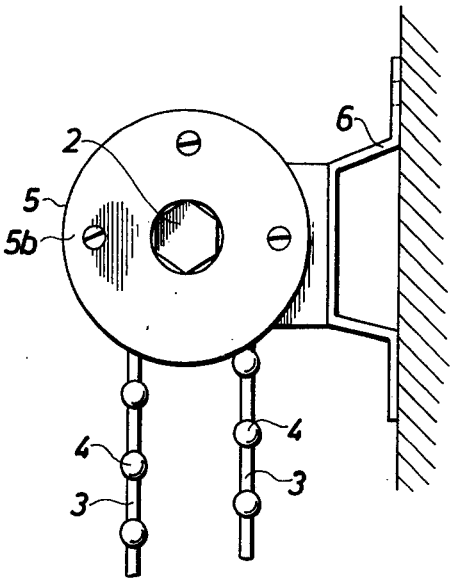
Figure 2:
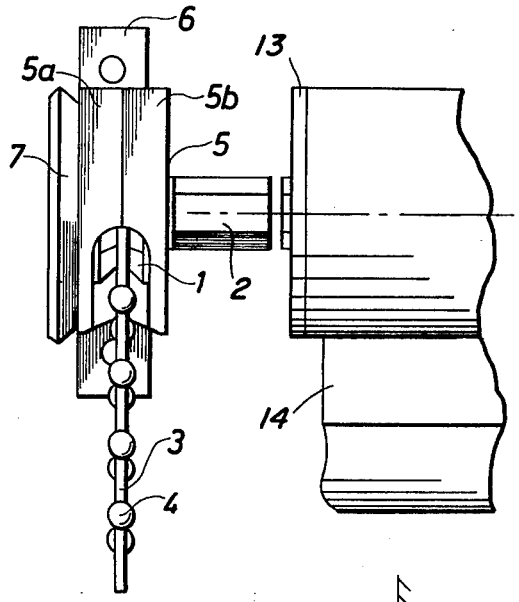
Figure 3:
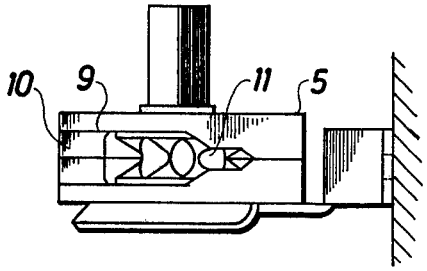
Figure 4:
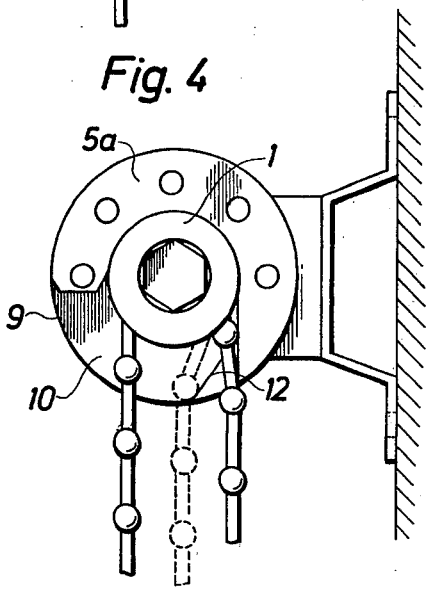
Figure 5:
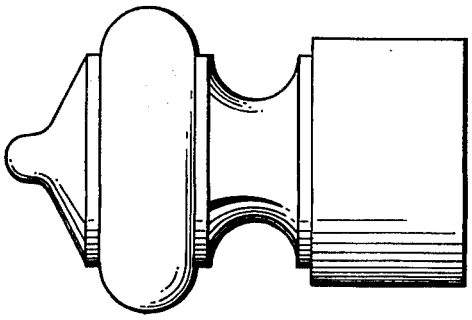

An embodiment of the invention is described in the following in connection with the attached drawing in which FIG. 1 is a side view of a ball cord lock in accordance with the invention, FIG. 2 is a plane view of the ball cord lock, FIG. 3 is a bottom view of the ball cord lock having the ball cord removed, FIG. 4 is a side view of the ball cord lock having one of the halves of the lock housing removed, and FIG. 5 is a side view of a decorative end knob intended to be mounted upon the ball cord lock in accordance with the invention.

FIGS. 1 and 2 show a ball cord lock comprising a cord pulley 1 having an extending stub axle 2 connected thereto, a ball cord 3 having balls 4 attached thereto and arranged around the cord pulley 1, a lock housing 5 enclosing the cord pulley 1 and which comprises of two lock housing halves 5*a* and 5*b* respectively, and a bracket 6 connected to the lock housing 5 and which is intended to be mounted upon a wall. The cord pulley 1 is shaped with a peripherial groove having recessed portions. Said portions correspond to the shape of the ball cord and form thereby an engagement connection between the ball cord and the cord pulley. The stub axle 2 is in this embodiment provided with a hexagonal cross-section but also other forms can be considered such as triangular or square form. The stub axle 2 is intended to be inserted into an opening of corresponding form in one end of a roller blind rod 13 whereby an engagement connection between the cord pulley and the roller blind rod is established. Hence, a pulling in one of the loops of the ball cord will be converted into a movement of rotation of the roller blind rod and vice versa. The bracket 6 which is made from a metal sheet blank shows an edge 7 extending along the periphery of the lock housing on the side of the lock housing 5 faced from the stub axle 2. Said extending edge 7 is intended to receive and keep a decoration such as an end knob shown in FIG. 5. The end knob as well as the cord pulley 1, the stub axle 2 and the lock housing 5 are made by plastic material and the diameter of the end knob at the connection location corresponds to the diameter of the lock housing whereby a smooth joint between the end knob and the lock housing is formed which gives the assembled roller blind an attractive look. The ball cord 3 should by reasons stated below be of a comparatively stiff material. In this embodiment a cord made by TERYLENE having plastic balls moulded thereonto is used.

FIG. 3 shows an opening 9 formed in the lower portion of the lock housing for the admittance of the ball cord to the cord pulley. The opening shows a broader portion 10 which allows the loop of the ball cord located remotest from the wall to run freely up against the cord pulley, and a narrower U-shaped portion 11 for locking the cord which allows admittance only for the cord portion of the ball cord and not the balls of the ball cord. The cord locking portion is arranged immediately below the periphery of the cord pulley and in the area of the one loop of the ball cord suspending freely from the cord pulley. In this embodiment the cord locking portion 11 is intended to catch and retain the loop of the ball cord closest to the wall which in one direction prevents rotation of the cord pulley. If a locking of the loop of the ball cord located furthest away from the wall should be desired the lock housing can either be turned around its axis or be turned half a revolution in relation to the bracket whereby the U-shaped portion will be located at the peripherial edge of the cord pulley faced away from the wall.

FIG. 4 shows in closer detail the shape of the opening 9 in one of the lock housing halves 5*a*. The lock housing halves 5*a*, 5*b* are mirror symmetrical due to which fact the opposite lock housing half 5*b* which here is removed has corresponding shape. The ball cord 3 is drawn by continuous lines in order to show it in the locked position in the one direction and by broken lines for the position which is taken by the ball cord when a pull force is applied to the loop of the ball cord closest to the wall.

From FIG. 4 it is clear that the broader portion 10 extends around substantially the whole lower peripherial portion of the cord pulley 1. The cord locking portion 11 which here is seen from the side has vertically in file depth and increasing extension from the open part of the portion at the periphery of the lock housing substantially vertical under the axis of the cord pulley towards the closed part of the portion which is delimited by a vertically delimiting surface from the periphery of the cord pulley. By this shape of the cord locking portion 11 there is formed a slip plane 12 for the balls 4 of the ball cord.

The operation of the ball cord lock is as follows: The cord pulley 1 is subjected to a counter-clockwise directed torque in FIGS. 1 or 4 from e.g. a completely or partially wound-up blind 14. The loop of the ball cord located closest to the wall will in this connection be located in the cord locking portion 11 and one of said balls will be retained against the peripherial surface of the lock housing by the force from the torque acting upon the ball cord. If an unwinding of the blind now is desired the ball cord 3 is moved out of the cord locking portion 11 and into the broader portion 10 and is retained in said portion until the blind has reached a desired position whereafter the ball cord is released. The ball cord is then caught by the cord locking portion 11 on one hand due to the own width of the cord, on the other hand due to its comperatively high stiffness. In connection with the wind-up of the blind onto the rod a downwardly directed force is applied onto the loop of the ball cord closest to the wall whereby the balls 4 of the ball cord will slip along the slip plane 12 outwardly towards the lower part of the broader portion 10. Hence, the slip plane 12 acts as a guide for the balls of the ball cord during the wind-up of the blind.

I claim:

1. Ball cord lock intended to be used for roller blinds and comprising a cord pulley having an axially extending stub axle for receiving and retaining one end of a roller blind rod, an endless ball cord arranged around said cord pulley and in engagement therewith and which during operation winds-up and unwinds respectively, a blind attached to said roller blind rod, a lock housing formed by two complementary housing halves which housing constitutes journal for and encloses said cord pulley, the outer peripheral surface of said lock housing being spaced from the outer peripheral surface of said cord pulley and including an aperture through which said ball cord extends from said cord pulley, said aperture comprising a U-shaped cord locking portion which is of such a dimension as to admit the adjacent cord portion of said ball cord and prevent admittance of the balls of said ball cord, the opening to said U-shaped cord locking portion facing the portion of said endless ball cord opposite said adjacent cord portion, the edge surfaces of said U-shaped cord locking portion constituting a slip plane upon which said balls sequentially slide, said slip plane being angularly oriented away from said outer peripheral surface of said lock housing and extending from said opening of said U-shaped cord locking portion towards the bite of said U-shaped cord locking portion, the height of said plane and therefore the height of said U-shaped portion, relative to said peripheral surface of said lock housing, increases from said opening to said bite, and a bracket which is connected to said lock housing and which is intended to be mounted at a window.

* * * * *